US009471008B2

(12) United States Patent
Inui et al.

(10) Patent No.: US 9,471,008 B2
(45) Date of Patent: Oct. 18, 2016

(54) DEVELOPER CONTAINER, PROCESS CARTRIDGE, AND IMAGE FORMING APPARATUS

(71) Applicant: CANON KABUSHIKI KAISHA, Tokyo (JP)

(72) Inventors: Fumiki Inui, Mishima (JP); Kenichi Nakao, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/826,391

(22) Filed: Aug. 14, 2015

(65) Prior Publication Data

US 2016/0054682 A1 Feb. 25, 2016

(30) Foreign Application Priority Data

Aug. 20, 2014 (JP) ..... 2014-167766

(51) Int. Cl.
*G03G 15/08* (2006.01)

(52) U.S. Cl.
CPC .... *G03G 15/0886* (2013.01); *G03G 2215/067* (2013.01)

(58) Field of Classification Search
CPC ..... G03G 15/0886; G03G 15/0881; G03G 21/1676; G03G 2215/067; G03G 2215/0692; G03G 2221/163
USPC ..... 399/111, 119, 120, 262
See application file for complete search history.

(56) References Cited

U.S. PATENT DOCUMENTS 8,494,417 B2 * 7/2013 Murase ..... G03G 15/0886 399/262 X
2008/0193169 A1 * 8/2008 Teramura ..... G03G 15/0886 399/262
2009/0185824 A1 * 7/2009 Murakami ..... G03G 15/0886 399/120
2009/0190963 A1 * 7/2009 Nozawa ..... G03G 15/0886 399/262
2010/0272465 A1 * 10/2010 Yamazaki ..... G03G 15/087 399/262 X
2011/0064479 A1 * 3/2011 Sasaki ..... G03G 15/0886 399/262
2012/0057905 A1 * 3/2012 Itabashi ..... G03G 15/0886 399/262 X
2012/0076549 A1 * 3/2012 Fujii ..... G03G 21/1676 399/262
2012/0099901 A1 * 4/2012 Sakai ..... G03G 15/0886 399/262 X
2015/0030355 A1 1/2015 Eto et al.

FOREIGN PATENT DOCUMENTS

JP 2013-160874 A 8/2013

* cited by examiner

*Primary Examiner* — Sophia S Chen
(74) *Attorney, Agent, or Firm* — Fitzpatrick, Cella, Harper & Scinto

(57) ABSTRACT

A contacting portion of a shutter appears in front of a container opening to be at a position where the contacting portion contacts with a sealing member provided in an edge of a storage body opening of a developer storage body when the shutter is at an opening position, and is separated from the sealing member to move into a container frame when the shutter moves from the opening position to a closing position. A non-contacting portion of the shutter is provided on an upstream-side of the contacting portion in a moving direction from the opening position to the closing position and is positioned inside the frame when the shutter is at the opening position, and moves to a position where the non-contacting portion appears in front of the container opening without making contact with the sealing member when the shutter moves from the opening position to the closing position.

19 Claims, 6 Drawing Sheets

SHUTTER OPEN STATE

INTERMEDIATE STATE

SHUTTER CLOSED STATE

SHUTTER OPEN STATE

FIG. 4B1
INTERMEDIATE STATE

SHUTTER CLOSED STATE

FIG. 4B2
INTERMEDIATE STATE

SHUTTER OPEN STATE

INTERMEDIATE STATE

SHUTTER CLOSED STATE

PRIOR ART PRIOR ART PRIOR ART

DEVELOPER CONTAINER, PROCESS CARTRIDGE, AND IMAGE FORMING APPARATUS

BACKGROUND OF THE INVENTION

1. Field of the Invention

The present invention relates to a developer container, a process cartridge, and an image forming apparatus.

2. Description of the Related Art

In an image forming apparatus such as a copying machine or a printer which uses an electrophotographic technique, a developing device supplies toner (developer) to an electrostatic latent image formed by exposing the uniformly charged surface of a photosensitive member during image information to form a toner image (visible image), and the toner image is transferred to a recording material to obtain an image. In such an apparatus, a cartridge (a process cartridge) in which a photosensitive member, a charging device, a developing device, a cleaning device, and the like are packaged in a frame different from the frame of an apparatus body has been practically used. And the cartridge which can be detachably attached to the apparatus body has been practically used. In such a process cartridge, a configuration in which a toner storage unit is formed as a toner container (a developer container) separated from a developing unit so as to be detachably attached to a cartridge frame is also proposed. Such a toner container is generally configured such that toner in the container is supplied to the developing unit through an opening formed in the toner container and the opening is opened and closed by a shutter.

SUMMARY OF THE INVENTION

FIGS. 8A to 8C are schematic cross-sectional views illustrating the operation and configuration of a shutter unit of a conventional toner container, in which FIG. 8A illustrates an open state of a shutter, FIG. 8B illustrates an intermediate state of opening and closing the shutter, and FIG. 8C illustrates a closed state of the shutter. A toner container unit 90 includes a toner feeding port 2 for discharging toner T in a storage unit to the outside and a shutter 91 for opening and closing the toner feeding port 2. A developing unit 30 includes an opening 32 through which the toner T is supplied and a sealing member 31 for preventing leakage of the toner T during the supply. In the drawings, toner is depicted at an enlarged scale for better understanding. In FIG. 8A, the shutter 91 is at an open position and the toner T in the toner container unit 90 is supplied to the developing unit 30 through the toner feeding port 2 and the opening 32. In this case, the shutter 91 and the sealing member 31 are in close contact so that the toner T does not leak to the outside. When the developing unit 30 is removed from the toner container unit 90, it is necessary to move the shutter 91 to a closing position to close the toner feeding port 2 of the toner container unit 90 to prevent leakage of the toner T. In this case, as illustrated in FIGS. 8B and 8C, with movement of the shutter 91, a portion of the toner T may enter between the shutter 91 and the sealing member 31 to adhere to the outer surface of the sealing member 31 and the shutter 91 being at the closing position. In such a state, when the toner container unit 90 is removed from the developing unit 30, since the surface of the shutter 91 is contaminated with the toner T, the toner T adhering to the shutter 91 may contaminate the place where the toner container unit 10 is placed or the hands of users.

An object of the present invention is to provide a technique of suppressing the leakage of developer during replacement of a developer container.

In order to attain the object, the present invention provides a developer container attached to a developer storage body, comprising:

a container frame that includes a container storing chamber, in which developer is stored, and a container opening; and a shutter that can move between a container opening position for opening the container opening and a container closing position for closing the container opening, wherein the shutter includes:

a contacting portion that appears in front of the container opening to be at a position where the contacting portion makes close-contact with a sealing member provided in an edge of a storage body opening of the developer storage body when the shutter is at the container opening position, and that is separated from the sealing member to move into the container frame when the shutter moves from the container opening position to the container closing position; and a non-contacting portion that is provided on an upstream side of the contacting portion in a moving direction from the container opening position to the container closing position and is positioned inside the container frame when the shutter is at the container opening position, and that moves to a position where the non-contacting portion appears in front of the container opening without making contact with the sealing member when the shutter moves from the container opening position to the container closing position.

In order to attain the object, the present invention provides a developing apparatus that is attached to an apparatus body of an image forming apparatus, comprising:

a developer carrying member, wherein the developer container is detachably attached to the developing apparatus.

In order to attain the object, the present invention provides a process cartridge that is detachably attached to an apparatus body of an image forming apparatus, wherein the developer container is detachably attached to the process cartridge.

In order to attain the object, the present invention provides an image forming apparatus that forms an image on a recording material, using developer, wherein the developer container is detachably attached to the image forming apparatus.

According to the present invention, it is possible to suppress the leakage of developer during replacement of a developer container.

Further features of the present invention will become apparent from the following description of exemplary embodiments with reference to the attached drawings.

BRIEF DESCRIPTION OF THE DRAWINGS

FIGS. 1A, 1B, and 10 are schematic cross-sectional views illustrating the periphery of a shutter unit of a developer container according to a first embodiment of the present invention;

FIGS. 4A, 4B1, 4B2, and 4C are schematic cross-sectional views illustrating the periphery of a shutter unit of a developer container according to a second embodiment of the present invention;

DESCRIPTION OF THE EMBODIMENTS

Hereinafter, aspects of the present invention will be exemplified in detail based on embodiments. However, dimensions, materials, shapes, relative positions, and the like of constituent components described in the embodiments are changed appropriately according to a configuration and various conditions of an apparatus to which the present invention is applied. That is, the scope of the present invention is not limited to the following embodiments.

First Embodiment

Here, an image forming apparatus is configured to form an image on a recording medium (a recording material) using developer (toner) according to an electrophotographic printing scheme. Examples of the image forming apparatus include an electrophotographic copying machine, an electrophotographic printer (a laser beam printer, an LED printer, or the like), an electrophotographic facsimile apparatus, and an electrophotographic word processor. Moreover, a process cartridge is a device in which at least one of an electrophotographic photosensitive member (a photosensitive member) which is an image bearing member and a process device that performs processes on the photosensitive member is integrated as a cartridge. A process cartridge is configured so as to be detachably attached to an apparatus body of the image forming apparatus. Examples of the process device include a charging device, a developing device, and a cleaning device. Moreover, a developing apparatus is a device used for developing an electrostatic latent image on a photosensitive member. The developing apparatus may form a part of the process cartridge and may be configured as an independent cartridge (a developing cartridge) that is detachably attached to an apparatus body of the image forming apparatus. Moreover, a developer container is a container that stores developer used for developing an electrostatic latent image formed on a photosensitive member and is detachably attached to an image forming apparatus, a process cartridge, or a developing apparatus. The developer container supplies developer to a developer storage portion (a developer storage body) of the image forming apparatus, the process cartridge, or the developing apparatus.

[Overall Configuration]

Figure 3:
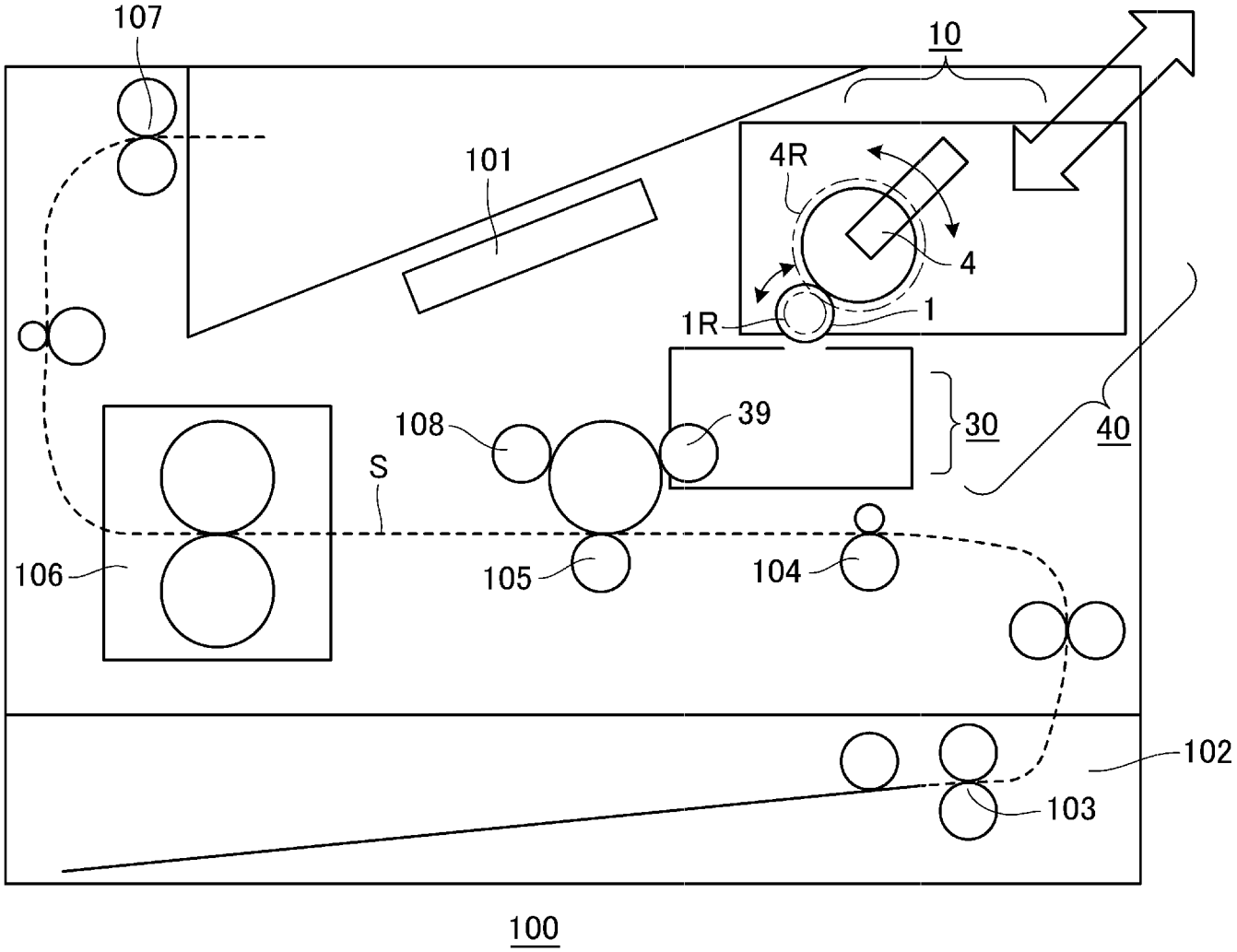
FIG. 3 is a schematic cross-sectional view of an image forming apparatus according to an embodiment of the present invention.

FIG. 3 is a schematic cross-sectional view illustrating an overall configuration of an image forming apparatus according to an embodiment of the present invention. An image forming apparatus 100 is an electrophotographic laser beam printer that has a process cartridge 40 including a toner container unit (a developer container) 10 that is detachably attached in the direction indicated by an arrow. In the image forming apparatus 100 according to the present embodiment, an apparatus body indicates a configuration portion excluding the process cartridge 40. In the apparatus body, a laser scanner unit 101 that forms a main part of an exposing device is disposed, and a sheet cassette 102 that stores sheet materials (recording materials) serving as an image forming target is disposed under the laser scanner unit 101. A feeding roller pair 103, a registration roller pair 104, a photosensitive member/transfer roller pair 105, a fixing unit 106, and a discharge roller pair 107 are disposed on the downstream side of the sheet cassette 102 in that order along a sheet material conveying direction. A charging device 108 and a cleaning device (not illustrated) are disposed around the photosensitive member. The symbol "S" designates a conveying path of a sheet material conveyed by the roller pairs and indicates a conveying direction of the sheet material.

The process cartridge 40 includes a toner container unit 10 and a developing unit 30 (a developer storage body and developing apparatus) having a developing roller 39 (a developer carrying member). The developing unit 30 is configured to be drawn (detachably attached to) from the image forming apparatus 100. An operating lever 4 that is rotatably supported is disposed in the toner container unit 10. When a user operates (rotates) the operating lever 4, the process cartridge 40 is locked or unlocked in relation to the image forming apparatus body. At the same time, a driving coupling of the photosensitive member is connected or disconnected (not illustrated).

The shutter 1 that opens and closes the toner feeding port 2 of the toner container unit 10 is formed in a cylindrical form and a shutter-side gear 1R is formed in a concentric form. An operating lever gear 4R is provided in the operating lever 4. When both gears are connected, the shutter 1 rotates with rotation of the operating lever 4 operated by a user. The shutter 1 is configured to open or close the toner feeding port 2 for discharging the toner T in the toner container unit 10 by rotating. When the user performs an operation of locking or unlocking the process cartridge 40, the shutter 1 is easily opened or closed.

[Description of Configuration of Shutter of Toner Container Unit]

Figure 1A:
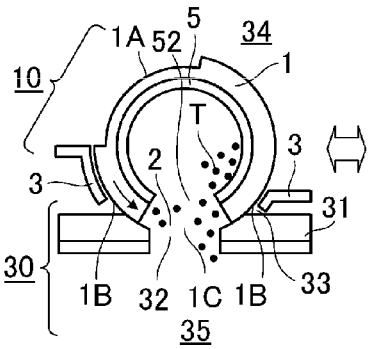
Figure 1B:
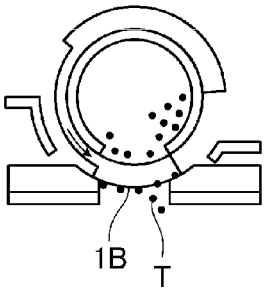
Figure 1C:
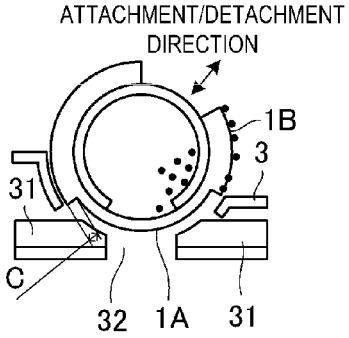
Figure 2:
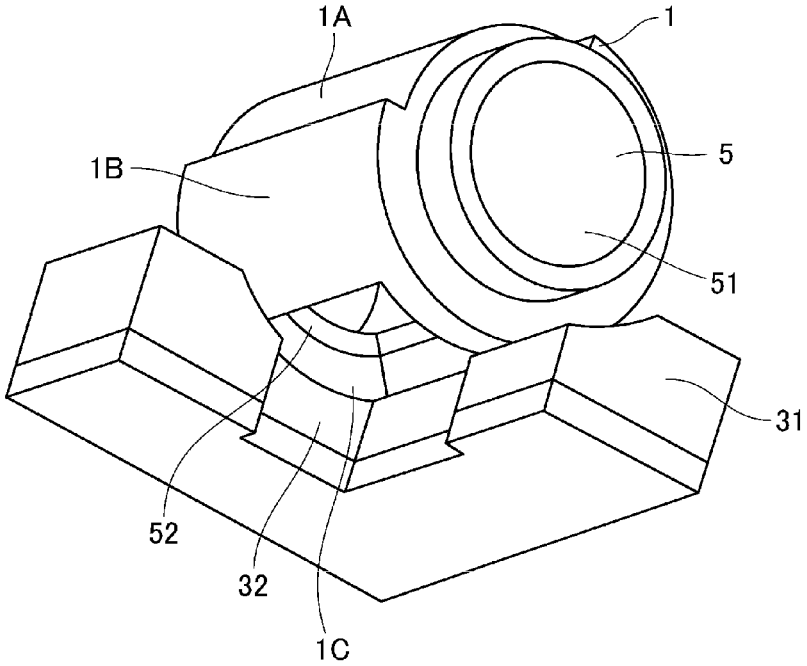
FIG. 2 is a schematic perspective view illustrating the periphery of the shutter unit of the developer container according to the first embodiment of the present invention.

FIGS. 1A to 1C are schematic cross-sectional views for describing the configuration and operation of the periphery of the shutter 1 of the toner container unit 10 according to the present embodiment, in which FIG. 1A illustrates an open state of a shutter, FIG. 1B illustrates an intermediate state of opening and closing the shutter, and FIG. 1C illustrates a closed state of the shutter. FIG. 2 is a perspective view (the shutter-side gear 1R is not illustrated) illustrating the periphery of the shutter 1 of the toner container unit 10 in the state of FIG. 1A, in which a configuration such as the sealing member 31 is partially cut so that the configuration in the longitudinal direction is easily understood.

The toner container unit 10 (a developer container) has a toner container 3 (a container frame) including a toner storing chamber 34 (a container storing chamber) in which the toner T is stored and an opening 33 (a container opening). Moreover, the toner container unit 10 includes the shutter 1 for opening and closing the opening 33 and a supporting portion 5 that supports the shutter 1 so as to be movable (rotatable).

The supporting portion 5 is formed in a cylindrical form as a part of the toner container 3 and is provided on the inner side of the opening 33 of the toner container 3. The supporting portion 5 has an inner cylinder portion 51 (the inner side of the cylindrical form) which is disposed in an open portion at one end of the cylindrical form so as to communicate with the inside (the toner storing chamber 34) of the toner container 3, and the toner T having moved through the open portion is stored in the inner cylinder portion 51. Moreover, the supporting portion 5 has an opening 52 (an opening of the supporting portion's opening) that passes through the circumferential wall of the cylindrical supporting portion 5.

The shutter 1 is a tubular member which is concentrically assembled so as to surround the outer circumferential surface of the supporting portion 5 and is supported so as to be rotatable around the outer circumferential surface of the supporting portion 5. The shutter 1 has a shutter opening 10 that passes through a tubular circumferential wall. The shutter 1 is configured to be movable in the circumferential direction on the outer circumferential surface of the supporting portion 5 to a position (a container opening position) at which the shutter opening 1C overlaps the opening 33 of the toner container 3 and the opening 52 of the supporting portion 5 and a position (a container closing position) at which the shutter opening 1C does not overlap the openings. When the shutter opening 1C, the opening 52, and the opening 33 overlap each other, the toner feeding port 2 of the toner container unit 10 is formed. The toner T can be supplied from the toner container unit 10 to the toner storing chamber 35 (a storage body storing chamber) of the developing unit 30 through a communication path formed by the toner feeding port 2 and the opening 32 (a storage body opening) of the developing unit 30.

The shutter 1 has a shutter contacting portion 1B that is provided on an outer circumferential surface (outer surface) so as to surround the shutter opening 1C. The shutter contacting portion 1B appears in front of the opening 33 of the toner container 3 to make close-contact with the sealing member 31 provided on the edge of the opening 32 of the developing unit 30 when the toner container unit 10 is attached to the developing unit 30 and the shutter 1 is at the container opening position. The sealing member is provided so as to surround the opening 32 and makes close-contact with the shutter contacting portion 1B to form an annular sealing surface that surrounds the opening 32. As a result, the toner feeding port 2 is sealed against the outside of the toner container unit 10 and the developing unit 30, and the toner T supplied from the toner container unit 10 to the developing unit 30 is suppressed from leaking to the outside.

Moreover, the shutter 1 has a shutter depressed portion 1A (a non-contacting portion) that is provided on the outer circumferential surface on the upstream side of the shutter contacting portion 1B in a moving direction when the shutter 1 moves from the container opening position to the container closing position. The shutter depressed portion 1A is a small-diameter portion that is formed in the outer circumferential surface of the shutter 1 so as to be depressed in relation to the shutter contacting portion 1B and extends in the longitudinal direction. The shutter depressed portion 1A does not make contact with the sealing member 31 during movement of the shutter 1. The shutter depressed portion 1A is a portion that appears in front of the opening 33 of the toner container 3 of the shutter 1 being at the container closing position.

[Attachment and Detachment of Toner Container Unit]

The toner container unit 10 is configured such that the shutter 1 is positioned at the container closing position in a state in which the toner container unit 10 is not attached to the developing unit 30. The user attaches the toner container unit 10 at a predetermined attachment position of the developing unit 30 and rotates the operating lever 4 to operate a lock mechanism (not illustrated) so that the process cartridge 40 is locked to the apparatus body. The shutter 1 moves (rotates) from the container closing position to the container opening position in synchronization with the locking operation of the user rotating the operating lever 4. As a result, a state in which the toner T can be supplied from the toner container unit 10 to the developing unit 30 is created.

When the toner container unit 10 is removed from the developing unit 30, the user rotates the operating lever 4 in a direction opposite to the direction for locking to unlock the process cartridge 40 from the apparatus body. The shutter 1 moves (rotates) from the container opening position to the container closing position in synchronization with the unlocking operation of the user rotating the operating lever 4 in the reverse direction. As a result, a state in which, when the user removes the toner container unit 10 from the developing unit 30, the toner T is suppressed from leaking outside from the toner container unit 10 is created.

Figures 8A, 8B, 8C:
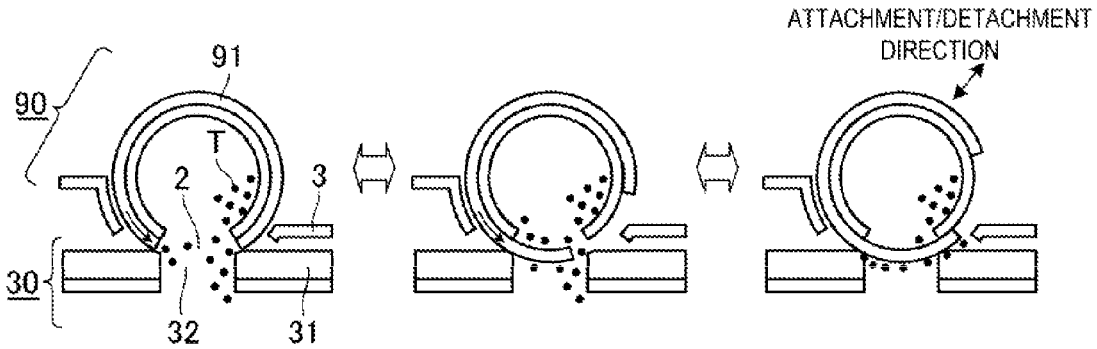
FIGS. 8A, 8B, and 8C are schematic cross-sectional views illustrating the periphery of a shutter unit of a developer container according to a conventional example.

Here, how the shutter 1 moves from the container opening position to the container closing position will be described in detail with reference to FIGS. 1A to 1C. In a state in which the shutter 1 is at the container opening position of FIG. 1A and is at the intermediate position of FIG. 1B during moving from the container opening position to the container closing position, the toner T is supplied from the toner container unit 10 to the developing unit 30 and the toner T adheres to the sealing member 31. Thus, the toner T also adheres to the shutter contacting portion 1B that makes sliding-contact with the sealing member 31 with movement of the shutter 1. This situation is the same as that of the conventional configuration illustrated in FIGS. 8A to 8C.

As illustrated in FIG. 1C, in the present embodiment, the shutter contacting portion 1B which appears in front of the opening 33 to make contact with the sealing member 31 is separated from the sealing member 31 with movement of the shutter 1 and moves into the toner container 3 through the opening 33. Moreover, a state in which the shutter depressed portion 1A of the shutter 1, which is not in contact with the sealing member 31 appears in front of the opening 33 is created. When the shutter 1 is continuously rotated from the state of FIG. 1B and the shutter contacting portion 1B is separated from the sealing member 31, the shutter depressed portion 1A provided on the upstream side of the shutter contacting portion 1B is positioned at a position facing the sealing member 31. The shutter depressed portion 1A is configured to be depressed by a predetermined amount (indicated by C in FIG. 1C) in the radial direction of the shutter 1 as compared to the shutter contacting portion 1B and faces the sealing member 31 with a gap. Thus, the toner T adhering to the sealing member 31 does not adhere to the shutter depressed portion 1A.

That is, with movement of the shutter 1 from the position of FIG. 1B to the position of FIG. 1C, a toner adhering portion (the shutter contacting portion 1B) of the shutter 1 is concealed inside the toner container 3 and a toner non-adhering portion (the shutter depressed portion 1A) appears in front of the opening 33. As a result, when the user removes from the toner container unit 10 from the developing unit 30, it is possible to suppress the surface of the toner container unit 10 (in particular, the surface near the opening 33 of the toner container 3) from being contaminated with toner. Therefore, for example, it is possible to suppress the place where the removed toner container unit 10 is placed or the hands of the user from being contaminated with toner.

Second Embodiment

A developer container according to a second embodiment of the present invention will be described with reference to FIGS. 4A to 6D. In this embodiment, the differences from the first embodiment will be described mainly. The same constituent elements as those of the first embodiment will be denoted by the same reference numerals and detailed description thereof will not be provided. The other constituent elements which are not described are the same as those of the first embodiment.

Figure 4A:
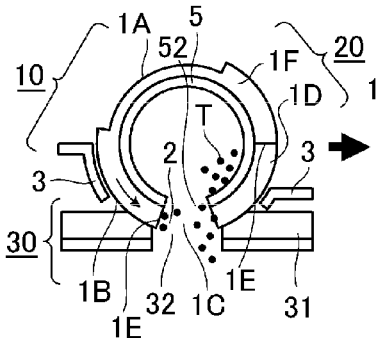
Figure 4A:
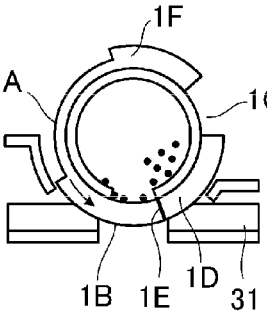
Figure 4C:
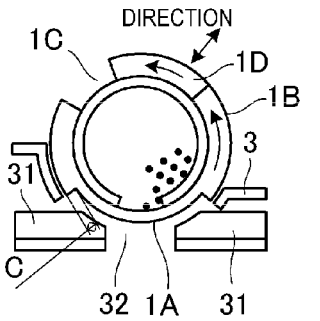
Figure 4C:
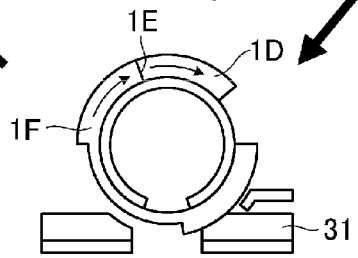

FIGS. 4A to 4C are schematic cross-sectional views for describing the configuration and operation of the periphery of a shutter of a toner container unit 10 according to the present embodiment, in which FIG. 4A illustrates an open state of a shutter, FIGS. 4B1 and 4B2 illustrate an intermediate state of opening and closing the shutter, and FIG. 4C illustrates a closed state of the shutter. The toner container unit 10 according to the present embodiment has a shutter having a different configuration from that of the first embodiment. Specifically, a shutter 20 of the toner container unit 10 according to the present embodiment includes a first shutter 1F and a second shutter 1D which are separate members.

Figure 6A:
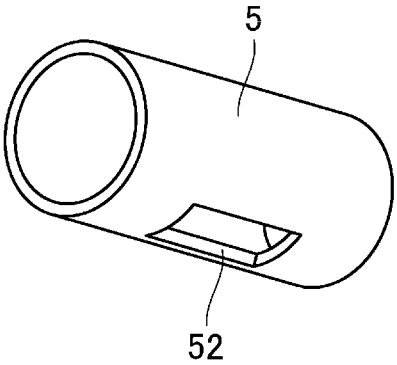
FIGS. 6A, 6B, 6C, and 6D are schematic perspective views illustrating a configuration of the shutter of the developer container according to the second embodiment of the present invention.
Figure 6B:
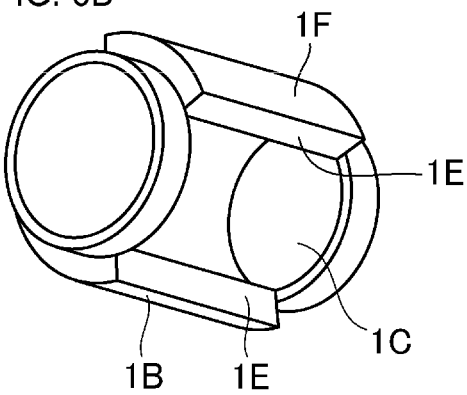
Figure 6C:
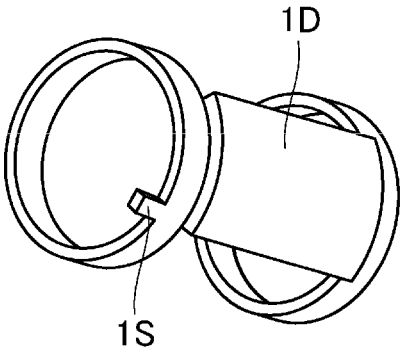
Figure 6D:
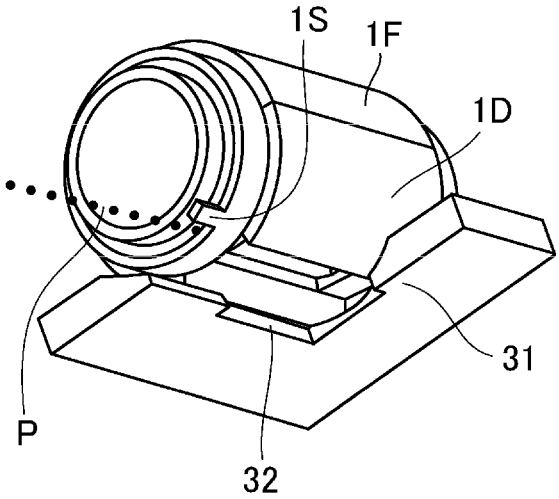

FIGS. 6A to 6D are schematic perspective views for describing the configuration of the shutter according to the present embodiment, in which FIGS. 6A, 6B, and 6C respectively illustrate a supporting portion 5, the first shutter 1F, and the second shutter 1D as single entities, and FIG. 6D illustrates some of peripheral configurations of the shutter 20 and an opening 32 of a developing unit 30. FIGS. 6A to 6C illustrate the respective constituent elements at the attitude and position corresponding to those of the state of FIG. 4A and the shutter-side gear 1R is not illustrated.

The first shutter 1F has the same configuration as the shutter 1 of the first embodiment and includes a shutter depressed portion 1A, a shutter contacting portion 1B, and a shutter opening 1C. The first shutter 1F is assembled to the supporting portion 5 so as to be rotatable. The first shutter 1F is connected coaxially with the shutter-side gear 1R illustrated in FIG. 3 similarly to the shutter 1 of the first embodiment and rotates around the supporting portion 5 with the operation of the operating lever 4.

The second shutter 1D is assembled to the supporting portion 5 so as to be rotatable coaxially with the first shutter 1F independently from the first shutter 1F and is not connected to the shutter-side gear 1R illustrated in FIG. 3. The second shutter 1D functions as a second contacting portion that makes close-contact with the sealing member 31 on the downstream side of the opening 32 in the moving direction of the first shutter 1F when the first shutter 1F is at the container opening position illustrated in FIG. 4A. In the present embodiment, when the shutter contacting portion 1B of the first shutter 1F and the second shutter 1D make close-contact with the sealing member 31, the toner feeding port 2 of the toner container unit 10 is sealed against the outside.

In the present embodiment, regarding sealing of the regions on both sides in the shutter rotating axis direction of the toner feeding port 2, the outer circumferential surfaces of ring portions on both sides in the rotating axis direction of the second shutter 1D make close-contact with the sealing member 31 whereby the toner feeding port 2 is sealed. That is, in the present embodiment, the region of the toner feeding port 2 on the upstream side in the shutter moving direction is sealed by the shutter contacting portion 1B of the first shutter 1F and the other regions are sealed by the second shutter 1D as the second contacting portion. For example, a contacting portion may be formed in the shutter contacting portion 1B of the first shutter 1F so as to extend in the circumferential direction from both ends in the rotating axis direction so that the contacting portion makes close-contact with the sealing member 31. In this way, the regions on both sides in the shutter rotating axis direction of the toner feeding port 2 may be sealed.

Moreover, the second shutter 1D has a stopper portion 1S for restricting the movement (rotation) of the second shutter 1D. The stopper portion 1S is a protruding portion that is provided in one of the ring portions of the second shutter 1D so as to extend in the rotating axis direction. The stopper portion 1S makes contact with a stopper functioning portion P provided in the toner container 3, indicated by a dot line in FIG. 6D to thereby restrict the movement of the second shutter 1D. When the stopper portion 1S makes contact with the stopper functioning portion P, the movement of the second shutter 1D in a direction opposite to the moving direction (the direction indicated by the arrow in FIG. 4A) of the first shutter 1F from the container opening position to the container closing position is restricted at the position illustrated in FIG. 4A (that is, the position (angle) at which the opening 32 is not blocked).

Moreover, a moving range (rotating range) of the second shutter 1D is restricted by the first shutter 1F. The first shutter 1F has abutting portions 1E that face each other in the circumferential direction with the shutter opening 1C interposed. One of the abutting portions 1E is provided at an end of the shutter contacting portion 1B. The movement of the second shutter 1D in the direction opposite to the direction of moving the first shutter 1F from the opening position to the closing position is restricted by the stopper functioning portion P and one of the abutting portions 1E. Moreover, the movement (the direction indicated by the arrow in FIG. 4C) of the second shutter 1D in the same direction as the direction of moving the first shutter 1F from the opening position to the closing position is restricted by the other abutting portion 1E.

FIG. 4A illustrates the open state of the shutter 20, in which the shutter contacting portion 1B of the first shutter 1F and the second shutter 1D make close-contact with the sealing member 31 to form an annular sealing surface that surrounds the opening 32. Thus, the toner T is supplied from the toner container 3 to the developing unit 30 through the toner feeding port 2 without leaking to the outside. In this case, the position of the second shutter 1D is restricted by the stopper functioning portion P. When the toner container unit 10 is removed from the developing unit 30, the user rotates the operating lever 4 to operate a lock mechanism (not illustrated) similarly to the first embodiment to unlock the process cartridge 40 from the apparatus body. With rotation of the operating lever 4, the first shutter 1F rotates in the direction indicated by the arrow in FIG. 4A.

As illustrated in FIG. 4B1, when the first shutter 1F moves in the direction indicated by the arrow from the container opening position illustrated in FIG. 4A to the container closing position, the abutting portion 1E formed on the shutter contacting portion 1B bumps into the second shutter 1D. The contacting surfaces of the abutting portion 1E and the second shutter 1D are configured so as to make abutting-contact with each other. When the abutting portion 1E and the second shutter 1D bump into each other, the toner feeding port 2 is closed.

Figure 5A:
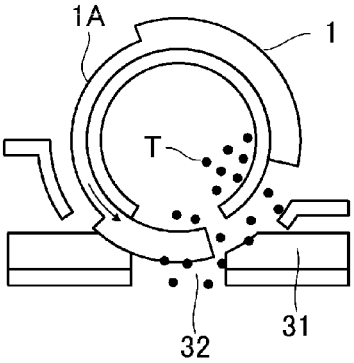
FIGS. 5A and 5B are schematic cross-sectional views illustrating the periphery of a shutter unit of a developer container according to an embodiment of the present invention.
Figure 5B:
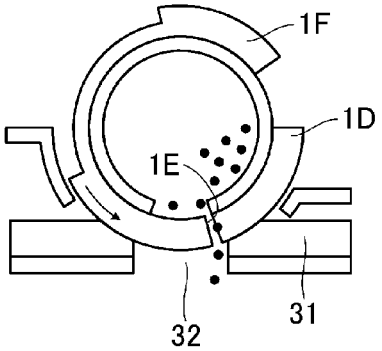

A change from the state of FIG. 4A to the state of FIG. 4B1 will be described in detail with reference to FIGS. 5A and 5B. FIGS. 5A and 5B are schematic cross-sectional views for describing a state before the shutter contacting portion 1B bumps into the second shutter 1D in the toner container unit 10 of the present embodiment, in which FIG. 5A illustrates the configuration of the first embodiment as a comparative example and FIG. 5B illustrates the configuration of the second embodiment. The position of the shutter of the first embodiment in FIG. 5A corresponds to the position of the first shutter 1F of the second embodiment in FIG. 5B.

As illustrated in FIG. 5A, in the configuration of the first embodiment, a portion of the toner T may leak from the opening in the course of closing the shutter 1 and may adhere to the periphery of the opening 32 such as the sealing member 31. That is, in the configuration of the first embodiment, although contamination of the shutter depressed portion 1A with toner (that is, contamination of the toner container 3 with toner) is suppressed, the periphery of the opening 32 of the developing unit 30 may be contaminated with toner.

As illustrated in FIG. 5B, in the configuration of the second embodiment, since the second shutter 1D that is movable in relation to the first shutter 1F does not rotate until the second shutter 1D bumps into the abutting portion 1E of the shutter contacting portion 1B, the state in which the second shutter 1D is in close-contact with the sealing member 31 is maintained. Thus, adhering of the toner T to the periphery of the opening 32 can be suppressed as much as possible. The toner feeding port 2 of the toner container 3 is closed when the abutting portion 1E of the shutter contacting portion 1B makes close-contact with the second shutter 1D. The second shutter 1D rotates in relation to the supporting portion 5 by being pressed by the shutter contacting portion 1B that makes contact with the second shutter 1D. That is, since the second shutter 1D starts rotating after the toner feeding port 2 is blocked, the second shutter 1D and the sealing member 31 maintain the close-contacting state by that time. Thus, the toner leaking from the toner feeding port 2 adheres to only the inner peripheral edge of the opening 32 and the region extending from the inner peripheral edge to the outer periphery of the opening 32 is not contaminated with toner.

As illustrated in FIG. 4C, after the first shutter 1F and the second shutter 1D make close-contact with each other to close the toner feeding port 2, the second shutter 1D and the shutter contacting portion 1B pass through the opening 33 and continues moving further until reaching the inside of the toner container 3 with the first and second shutters 1F and 1D maintaining the close-contacting state. As a result, similarly to the shutter 1 of the first embodiment, a toner adhering portion (the shutter contacting portion 1B and the second shutter 1D) of the shutter is concealed inside the toner container 3, and a toner non-adhering portion (the shutter depressed portion 1A) appears in front of the opening 33.

Therefore, according to the present embodiment, similarly to the first embodiment, when the user removes from the toner container unit 10 from the developing unit 30, it is possible to suppress the surface near the opening 33 of the toner container 3 from being contaminated with toner. Further, according to the present embodiment, it is possible to suppress the periphery of the opening 32 of the developing unit 30 from being contaminated with toner (see FIG. 5B).

FIG. 4B2 illustrates an intermediate state of returning from the shutter closed state of FIG. 4C to the shutter open state of FIG. 4A. When the first shutter 1F moves from the container closing position to the container opening position, the abutting portion 1E on the opposite side of the abutting portion 1E of the shutter contacting portion 1B bumps into the second shutter 1D and the second shutter 1D moves with movement of the first shutter 1F. The second shutter 1D moves together with the first shutter 1F until the movement is restricted by the stopper functioning portion P, and the shutter 20 returns to the state illustrated in FIG. 4A.

Third Embodiment

Figure 7A:
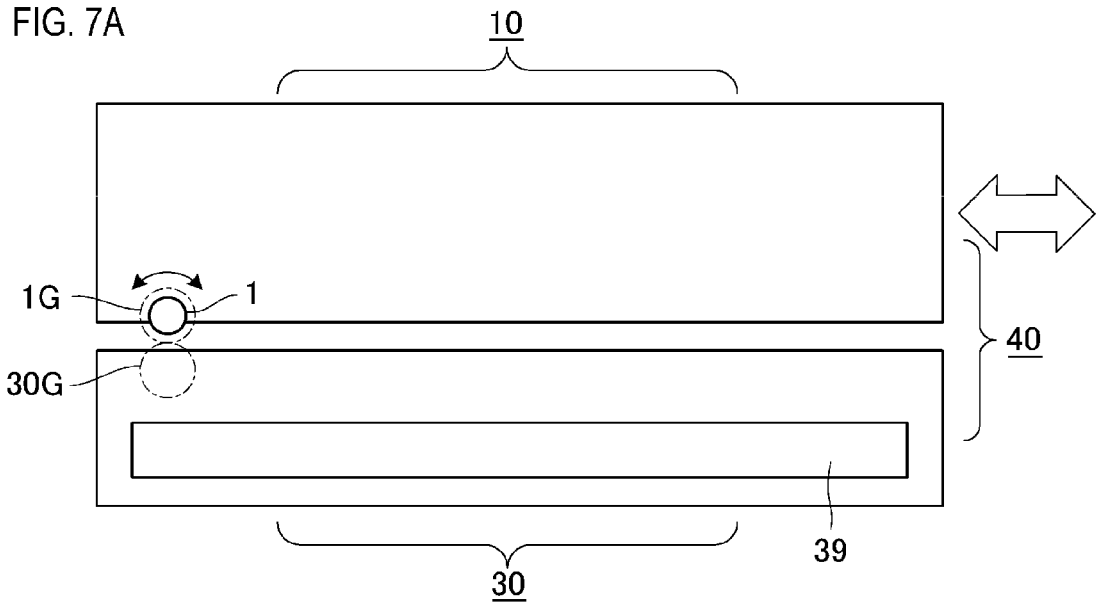
FIGS. 7A and 7B are diagrams for describing an attachment/detachment configuration of a developer container according to a third embodiment of the present invention.
Figure 7B:
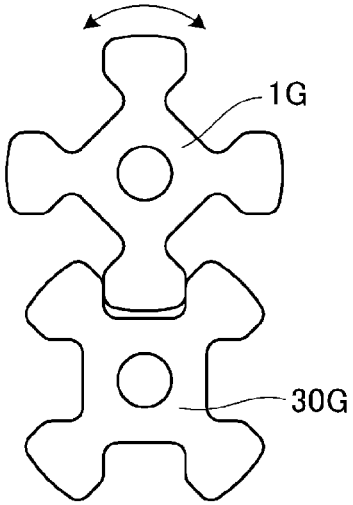

A developer container according to a third embodiment of the present invention will be described with reference to FIGS. 7A and 7B. FIGS. 7A and 7B are diagrams for describing an attachment and detachment configuration of a toner container unit and a developing unit according to the present embodiment, in which FIG. 7A is a schematic plan view of the toner container unit and the developing unit when seen in a rotating axis direction of the shutter and FIG. 7B is a schematic enlarged view of a shutter gear and a developing unit gear. In this embodiment, the differences from the first and second embodiments will be described mainly. The same constituent elements as those of the first and second embodiments will be denoted by the same reference numerals and detailed description thereof will not be provided. The other constituent elements which are not described are the same as those of the first and second embodiments.

A toner container unit 10 according to the present embodiment is configured such that a shutter is opened and closed in synchronization with an operation of attaching and detaching the toner container unit 10 to and from the developing unit 30 unlike the first and second embodiments. As illustrated in FIG. 3, in the first and second embodiments, the toner container unit 10 is attached to the developing unit 30 from an obliquely upper side. In contrast, as illustrated in FIGS. 7A and 7B, in the third embodiment, the toner container unit 10 is moved in a direction vertical to the direction of conveying a sheet material in the image forming apparatus and is attached to the developing unit 30. Moreover, in the third embodiment, the direction in which constituent elements of a shutter portion of the toner container unit 10 is provided is different from that of the first and second embodiments. Specifically, in the first and second embodiments, the rotating axis of the shutter of the toner container unit 10 is parallel to the rotating axis of the developing roller 39 or the like as illustrated in FIG. 3. In contrast, in the third embodiment, the rotating axis of the shutter is orthogonal to the rotating axis of the developing roller 39 of the like as illustrated in FIGS. 7A and 7B.

The toner container unit 10 according to the present embodiment has a shutter gear 1G (a moving portion) that is integrally assembled concentrically with the shutter. The shutter gear 1G is provided together with the shutter so as to be rotatable about the rotating axis in the direction (the direction vertical to the sheet surface of FIGS. 7A and 7B) vertical to the moving direction (the left-right direction of the sheet surface of FIGS. 7A and 7B) during attachment of the toner container unit 10 to the developing unit 30. A developing unit gear 30G (an engagement portion) for rotating the shutter gear 1G of the toner container unit 10 is fixed to the developing unit 30. A rack may be used instead of the developing unit gear 30G.

As illustrated in FIG. 7A, the toner container unit 10 is moved in relation to the developing unit 30 in a direction orthogonal to the rotating axis of the shutter gear 1G during the attachment. The shutter gear 1G engages with the developing unit gear 30G before the toner container unit 10 reaches a predetermined attachment completion position at which the toner container unit 10 is completely attached to the developing unit 30. After the shutter gear 1G engages with the developing unit gear 30G, when the toner container unit 10 is moved further in relation to the developing unit 30 toward the attachment completion position, the shutter gear 1G rotates by engaging with the developing unit gear 30G. The shutter gear 1G is configured to rotate so that the shutter is positioned at the container opening position (see FIGS. 1A and 4A) when the toner container unit 10 reaches the predetermined attachment completion position at which the toner container unit is completely attached to the developing unit 30. The configuration for opening and closing the shutter portion of the toner container unit 10 according to the present embodiment is the same as that of the first and second embodiments, and description thereof will not be provided.

When the toner container unit 10 is removed from the developing unit 30, the toner container unit 10 is moved in relation to the developing unit 30 in the direction opposite to the direction for attachment. In this case, the shutter gear 1G rotates in the direction opposite to the direction for attachment and disengages with the developing unit gear 30G after the shutter is positioned at the container closing position.

According to the third embodiment, the shutter can be opened and closed just by the operation of attaching and detaching the toner container unit 10 without requiring the operation of the user operating the operating lever as in the first and second embodiments. Thus, it is possible to improve the workability during replacement of the toner container unit 10. Although a rotary shutter has been used as a shutter configuration in the above-described embodiments, a shutter configuration in which a shutter slides linearly to open and close an opening may be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-167766, filed on Aug. 20, 2014, which is hereby incorporated by reference herein in its entirety.

What is claimed is:

1. A developer container attached to a developer storage body, the developer container comprising:

a container frame that includes a container storing chamber, in which developer is stored, and a container opening; and a shutter that can move between a container opening position for opening the container opening and a container closing position for closing the container opening, wherein the shutter includes:

a contacting portion that (i) appears in front of the container opening to be at a position where the contacting portion makes close-contact with a sealing member provided at an edge of a storage body opening of the developer storage body when the shutter is at the container opening position, and (ii) is separated from the sealing member to move into the container frame when the shutter moves from the container opening position to the container closing position; and a non-contacting portion that is provided on an upstream side of the contacting portion in a moving direction from the container opening position to the container closing position and is positioned inside the container frame when the shutter is at the container opening position, and that moves to a position where the non-contacting portion appears in front of the container opening without making contact with the sealing member when the shutter moves from the container opening position to the container closing position.

2. The developer container according to claim 1, wherein the contacting portion is provided on an outer surface of the shutter facing the storage body opening, and the non-contacting portion is a depressed portion formed in the outer surface so as to be depressed in relation to the contacting portion.

3. The developer container according to claim 1, wherein the contacting portion makes close-contact with the sealing member so that, when the shutter is at the container opening position, a communication path formed by the container opening and the storage body opening is sealed by the sealing member and the developer does not leak to the outside of the developer container and the developer storage body.

4. The developer container according to claim 1, wherein the shutter has a shutter opening that connects the container storing chamber and the container opening with each other at the container opening position so that the developer is allowed to move from the developer container to the developer storage body.

5. The developer container according to claim 4, wherein the contacting portion is provided so as to surround the shutter opening and makes close-contact with the sealing member provided so as to surround the storage body opening so that a communication path formed by the container opening, the shutter opening, and the storage body opening is sealed against the outside of the developer container and the developer storage body when the shutter is at the container opening position.

6. The developer container according to claim 1, further comprising:

a supporting portion that is provided on an inner side of the container opening so as to support the shutter to be movable.

7. The developer container according to claim 6, wherein the supporting portion has a supporting portion opening that connects the container opening and the container storing chamber with each other when the shutter is at the container opening position.

8. The developer container according to claim 6, wherein the supporting portion has a cylindrical outer circumferential surface, and the shutter moves on the outer circumferential surface in a circumferential direction.

9. The developer container according to claim 8, wherein the shutter is a tubular member that surrounds the outer circumferential surface and is assembled to be rotatable around the outer circumferential surface.

10. The developer container according to claim 6, wherein the shutter surrounds an outer surface of the supporting portion.

11. The developer container according to claim 1, further comprising:

a second contacting portion provided be movable in relation to the shutter, wherein, when the shutter is at the container opening position, the second contacting portion makes close-contact with the sealing member on at least a downstream side of the container opening in the moving direction, and when the shutter moves from the container opening position to the container closing position, the second contacting portion first makes close-contact with the contacting portion so that the container opening is closed and then moves into the container frame together with the contacting portion while maintaining the close-contacting state.

12. The developer container according to claim 1, wherein the developer container is detachably attached to the developer storage body.

13. The developer container according to claim 12, wherein the shutter moves between the container opening position and the container closing position in synchronization with movement in relation to the developer storage body during attachment and detachment to and from the developer storage body.

14. The developer container according to claim 13, further comprising:

a moving portion that moves integrally with the shutter, wherein, when the moving portion moves by engaging with an engagement portion provided in the developer storage body during attachment and detachment to and from the developer storage body, the shutter moves between the container opening position and the container closing position.

15. A developing apparatus that is attached to an apparatus body of an image forming apparatus, the developing apparatus comprising:

a developer carrying member, wherein the developer container according to claim 1 is detachably attached to the developing apparatus.

16. A process cartridge that is detachably attached to an apparatus body of an image forming apparatus, wherein the developer container according to claim 1 is detachably attached to the process cartridge.

17. The process cartridge according to claim 16, wherein the shutter moves from the container closing position to the container opening position in synchronization with an operation of locking the process cartridge to the apparatus body, and the shutter moves from the container opening position to the container closing position in synchronization with an unlocking operation.

18. An image forming apparatus that forms an image on a recording material, using developer, wherein the developer container according to claim 1 is detachably attached to the image forming apparatus.

19. A developer container attached to a developer storage body, the developer container comprising:

a container frame that includes a container storing chamber, in which developer is stored, and a container opening; and a shutter that can move between a container opening position for opening the container opening and a container closing position for closing the container opening, wherein the shutter includes:

a contacting portion that (i) appears in front of the container opening to be at a position where the contacting portion makes close-contact with a sealing member provided at an edge of a storage body opening of the developer storage body when the shutter is at the container opening position, and (ii) is separated from the sealing member to move into the container frame when the shutter moves from the container opening position to the container closing position; and a depressed portion that is provided on an upstream side of the contacting portion in a moving direction from the container opening position to the container closing position and is positioned inside the container frame when the shutter is at the container opening position, wherein, when the shutter moves from the container opening position to the container closing position, the depressed portion moves to a position where the depressed portion appears in front of the container opening and faces the sealing member with a gap.

* * * * *